US010238216B2

(12) United States Patent
Casilio

(10) Patent No.: US 10,238,216 B2
(45) Date of Patent: Mar. 26, 2019

(54) STOOL

(71) Applicant: Art Design Works LLC, Lexington, MA (US)

(72) Inventor: Kelly Louise Casilio, West Newton, MA (US)

(73) Assignee: Art Design Works LLC, Lexington, MA (US)

( * ) Notice: Subject to any disclaimer, the term of this patent is extended or adjusted under 35 U.S.C. 154(b) by 0 days.

(21) Appl. No.: 15/476,214

(22) Filed: Mar. 31, 2017

(65) Prior Publication Data

US 2018/0279792 A1 Oct. 4, 2018

(51) Int. Cl.

| | |
|---|---|
| ***A47C 9/00*** | (2006.01) |
| ***A47C 7/00*** | (2006.01) |
| ***A47C 7/02*** | (2006.01) |
| ***A47B 13/08*** | (2006.01) |
| ***A47B 13/02*** | (2006.01) |

(52) U.S. Cl.

CPC ..... *A47C 9/00* (2013.01); *A47B 13/023* (2013.01); *A47B 13/08* (2013.01); *A47C 7/004* (2013.01); *A47C 7/021* (2013.01); *A47B 2013/024* (2013.01); *A47B 2200/0021* (2013.01)

(58) Field of Classification Search

CPC ..... A47C 9/00; A47C 7/021; A47C 7/004; A47B 13/023; A47B 13/08

USPC ..... 297/219.1

See application file for complete search history.

(56) References Cited

U.S. PATENT DOCUMENTS

| | | | | | |
|---|---|---|---|---|---|
| 942,793 | A * | 12/1909 | Reineke | | |
| 4,475,768 | A * | 10/1984 | Webb | A47C 31/11 | 297/219.1 |
| 5,487,587 | A * | 1/1996 | Hylton | A47C 27/00 | 297/219.1 |
| 6,655,734 | B2 * | 12/2003 | Hunter | B62B 3/144 | 297/219.1 |

FOREIGN PATENT DOCUMENTS

DE 19702859 A1 * 10/1997 ..... A47C 9/002

OTHER PUBLICATIONS

[No Author Listed] Giant-Post-It-Notes-Table. Snoring Scholar. https://www.snoringscholar.com/what-youre-missing/giant-post-it-notes-table/, 3 pages [last accessed Sep. 27, 2018].

Colombo, Giant Post-it Note Table. Makezine.com. https://makezine.com/2012/06/13/giant-post-it-note-table/, Jun. 13, 2012, 4 pages.

* cited by examiner

*Primary Examiner* — Anthony D Barfield

(74) *Attorney, Agent, or Firm* — Wolf, Greenfield & Sacks, P.C.

(57) ABSTRACT

A stool and a plurality of coverings which are held to a top of the stool via a retaining member are disclosed. In some embodiments, the stool includes a top and a base, the plurality of coverings being held to the top of the stool via the retaining member. The retaining member may be attached to the base and/or top via biasing members that pull the retaining member toward the top of the stool. The coverings include an opening through which the retaining member is passable.

22 Claims, 6 Drawing Sheets

STOOL

FIELD

The disclosed embodiments relate generally to stools, and more particularly to stools with removable covers.

BACKGROUND

Typically, stools are used for support. For example, a stool may be used to support a seated person. In another example, the stool may be used as a table on which items, such as food, can be placed. Some stools may be covered, such as with a table cloth, to protect their surfaces and to facilitate cleaning.

SUMMARY

According to one embodiment, a stool is disclosed. The stool includes a top having a top surface, a base supporting the top, a plurality of coverings stacked on the top surface, and a retaining member attached to at least one of the top and the base, and biased in a direction toward the top of the stool. The retaining member is arranged to hold the coverings to the top of the stool.

According to another embodiment, method of holding a covering on a stool is disclosed. The stool includes a top, a base supporting the top, and a retaining member attached to at least one of the top and the base and biased in a direction toward the top of the stool, the retaining member arranged to hold one or more coverings to the top of the stool. The method includes moving the retaining member in a direction away from the top of the stool to an extended position, inserting the retaining member through an opening of a first covering, and placing the first covering on the top of the stool.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

DETAILED DESCRIPTION

Figure 1:
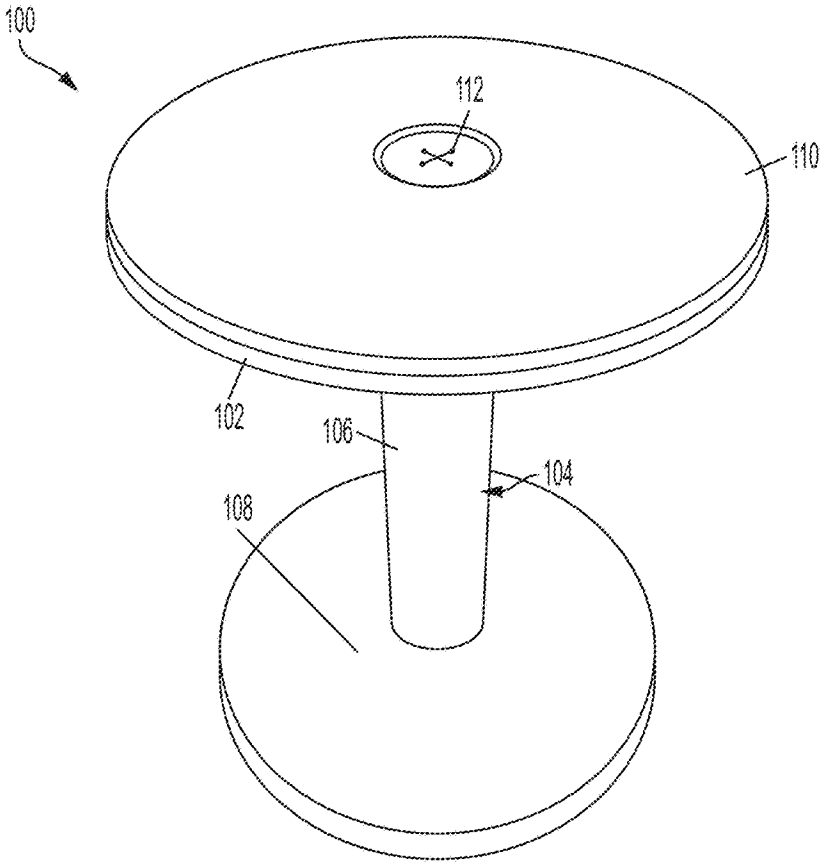
FIG. 1 is a perspective view of a stool according to one embodiment.

Stools may be used to support various types of items and people. For example, a stool may be used to sit on or as a place to set books, foods, and/or beverages. Accordingly, in some embodiments, the stool may function as a chair and/or as a table. Stools may become dirty with use. For example, when a stool is used to serve food, the stool may become soiled by food residue and need cleaning. Stools may be covered with a piece of paper or fabric place over the top of the stool, the paper or fabric being removed after use. Paper table cloths are typically thrown out after use, and fabric table cloths are typically reusable, though the table cloth is typically washed after use. The table coverings are often stored in a separate location from the table, such as on a shelf or in a cabinet.

Applicant has recognized that providing a stool with removable coverings which are held to the stool may provide advantages. For example, such a removable covering allows for efficient cleaning as the user may be able to remove the dirty covering at the top of the stack to reveal a fresh, clean covering underneath. Additionally, because the unused coverings are maintained on top of the stool, no separate storage location is required. This arrangement also may allow the user to keep track of the number of clean coverings because the coverings are visible on top of the stool, and helps avoid losing coverings. Finally, as the coverings are held to the stool during use, instances of the covering being accidentally removed from the stool, such as by a child, may be reduced.

Accordingly, embodiments disclosed herein include a stool having a top, a base, a retaining member, and a plurality of coverings that are held to the stool by the retaining member. As will be appreciated, a stool may include a table, an ottoman, or another suitable structure with a surface for supporting one or more articles, such as food items.

For purposes herein, being held to the stool means that a stack of coverings is maintained on top of the stool via a retaining member. For example, a retaining member may hold the stack of coverings to the top of the stool such that the coverings do not substantially move relative to the stool. In such an example, the coverings may remain aligned with one another and with the top of the stool via the retaining member. In some embodiments, the coverings may move slightly relative to the stool during use. For example, one or more coverings may be moved (e.g., rotated or translated) relative to the top surface. In embodiments in which the coverings do move relative to the table, such as during use, the user may manually adjust the position of the coverings. For example, the user may rotate or translate the stack of coverings, or one of the coverings in the stack, back to an aligned position.

The coverings may be sized to fit on the top of the stool. In some embodiments, the coverings may cover at least part of the top of the stool. For example, the coverings may be sized to cover the entire top of the stool. In other embodiments, the coverings are larger than the size of the top of the stool. For example, at least a portion of the coverings may extend beyond a periphery of the top of the stool to cover at least a portion of a side of the stool.

In some embodiments, the coverings may be attached to one another in the stack. For example, the stack of coverings may be bound together at a portion of the perimeter. For example, the edges of the coverings may be fixed together by an adhesive or other attachment means, such as wax. In other embodiments, at least a portion of each covering may have an adhesive, such as an adhesive on a portion of a bottom surface of the covering, positioned such that a first covering may stick to an adjacent covering. As will be appreciated, in such embodiments, removal of a covering from the stack may comprise tearing, unsticking, or otherwise unfastening the covering from the stack. In such embodiments, even if each of the coverings are attached to one another, each covering is still held to the top of the stool via the retaining member.

In other embodiments, the coverings may not be individually attached to one another. In such embodiments, the coverings may be formed of a material, such a felt, that resists movement of one covering relative to an adjacent covering when the coverings are stacked on top of one another. In such embodiments, the covering may be removed from the stack by simply grasping and moving the covering in a direction away from the top of the stack.

In some instances the coverings may be disposable, such that the user may discard the used covering after use. In other embodiments, the coverings may be reusable. In such instances, the coverings may be collected, washed, and then restacked on top of the stool at a later time.

The coverings may all have the same size, shape, and color, or the characteristics may differ among the coverings. For example, a user may attach coverings of different materials depending on the use. In one such example, the user may place a disposable paper covering on the table to be used to take notes during a meeting and may place a cloth covering on the table for use as a table cloth. The user also may attach a covering having different colors for decorative purposes.

In some embodiments, each covering has an opening through which the retaining member is passed. In such embodiments, the retaining member is passed through the opening and the covering is placed on top of the stool or on top of a stack of coverings on the stool top. Once the covering is in place, the covering may be sandwiched between the retaining member and the top of the stool, or between the retaining member and the covering previously at the top of the stack, such that the covering is held in place. In such embodiments, the retaining member rests on top of the stack of coverings.

The opening in the covering may be a slit, a circle, or another suitably shaped opening. The opening may be cut into the plurality of coverings after the coverings have been stacked on top of one another such that the openings are aligned with one another. The openings also may be formed in each covering during manufacturing, with the coverings being stacked when they are placed on the stool. As will be appreciated, in such embodiments, the openings may be aligned, however, the openings also may be offset in other embodiments depending upon placement of the coverings on the stool. In some embodiments, the area around the opening may be depressed such that the retaining member may rest in the depression when the covering is on the stool.

In some embodiments, the retaining member includes a disk. As will be appreciated, the disk may be any suitable shape, such as circular, rectangular, oval, triangular, other polygonal, or another suitable shape. At least a portion of the disk is sized to fit through the opening in the covering. For example, the retaining member may include an oval disk, with a first dimension that is smaller than the opening and a second dimension that is larger than the opening. In other embodiments, the retaining member may be smaller than the opening. In such embodiments, the opening may include a slit that closes after passage of the retaining member.

In some embodiments, the retaining member may have at least two positions—a holding position and an extended or open position. The holding position is a position in which the retaining member holds the one or more coverings to the top of the stool. In the extended position, the retaining member is moved in a direction away from the top of the stool such that the retaining member may be moveable through the opening in a covering. As will be appreciated, the retaining member may be moveable such that the covering may be placed on top of the stool or may be removed from the top of the stool. For example, in the extended position, the retaining member may be passable through the covering for placement of the covering on the stool. In some embodiments, the retaining member may be positioned substantially parallel to the coverings when the retaining member is in the holding position. The retaining member also may be positioned substantially parallel to the stool top in the holding position. In some embodiments, the retaining member may be positioned at an angle relative to the coverings and to the table when the retaining member is in the extended or open position.

In some embodiments, the retaining member is attached to the table via one or more biasing members, such as elastic bands. In some embodiments, the one or more biasing members may be attached to only one side of retaining member. For example, elastic bands may be attached to the side of the disk that is positioned adjacent to the coverings being held to the stool top. The retaining member also may be hollow, with the one or more biasing members being attached within the retaining members. The biasing members may be removably attached to the retaining member or permanently attached (e.g., by glue or another suitable attachment method). The one or more biasing members may be evenly spaced across the retaining member, or may be unevenly spaced.

The biasing members may bias the retaining member in the holding position, in a direction toward the top of the stool. For example, the biasing members may be taut when the retaining member is flush against the stack of coverings, such that the coverings are held to the top of the stool. In some embodiments, to attach a covering, the user may grasp and pull the retaining member in a direction away from the top of the stool to the extended position to load or remove a covering from the stool top. In such an extended position, the biasing members are stretched. After the covering has been placed in a desired position on the stool or stack of coverings on the stool, or has been removed from the stool, the retaining member is released. When the retaining member is released, the biasing members contract and pull the retaining member toward the top of the stool, back to the holding position.

The biasing members are arranged to be sufficiently stretchable that the retaining member may be moved away from (e.g., lifted off of) the stack of coverings. In some embodiments, for example, the retaining member may be moveable to between 0.5 inches and 3 inches from the top of the stack of coverings. The retaining member also may be moveable to other suitable distances from the top of the stack of covering in other embodiments. As will be appreciated, in embodiments having more than one biasing member, the biasing members may be the same length and apply the same biasing force. The biasing members also may be different lengths and apply different forces. For example, some of the biasing members may be stretchable more than others. The thickness of the biasing members also may be the same or may vary. In some embodiments, irrespective of how few coverings remain in the stack, the number, length and thickness and number of the biasing members are arranged to hold the coverings to the top of the stool.

In some embodiments, the one or more biasing members may be attached to the top of the stool. In other embodiments, the biasing member may be attached to a portion of the base.

In some embodiments, the base may include one or more legs. The base also may be formed in the shape of a pedestal. In some embodiments, the base may be at least partially hollow, such as a hollow pedestal. In such embodiments, the openings in the coverings and the retaining member may align with the hollow portion of the base, such that the one or more biasing members may extend through the hollow portion of the base. In some embodiments, the base may be one integral piece. In other embodiments, the base may be formed of multiple parts that may be screwed, snapped, or otherwise attached to one another. As will be appreciated, the base is arranged to rest stably on a surface.

Turning now to the figures, FIG. 1 shows an embodiment of a stool 100 according to embodiments of the present disclosure. As shown in this view, the stool includes a top 102 and a base 104 attached to the top. In some embodiments, one or more stool coverings 110 are placed on the stool top 102 and are held to the top 102 via a retaining member 112.

In some embodiments, the base and top may be permanently attached to one another (e.g., via glue, screws, etc.). The base also may be integrally formed with the top. In other embodiments, the top may be removably attached to the base.

Figure 2:
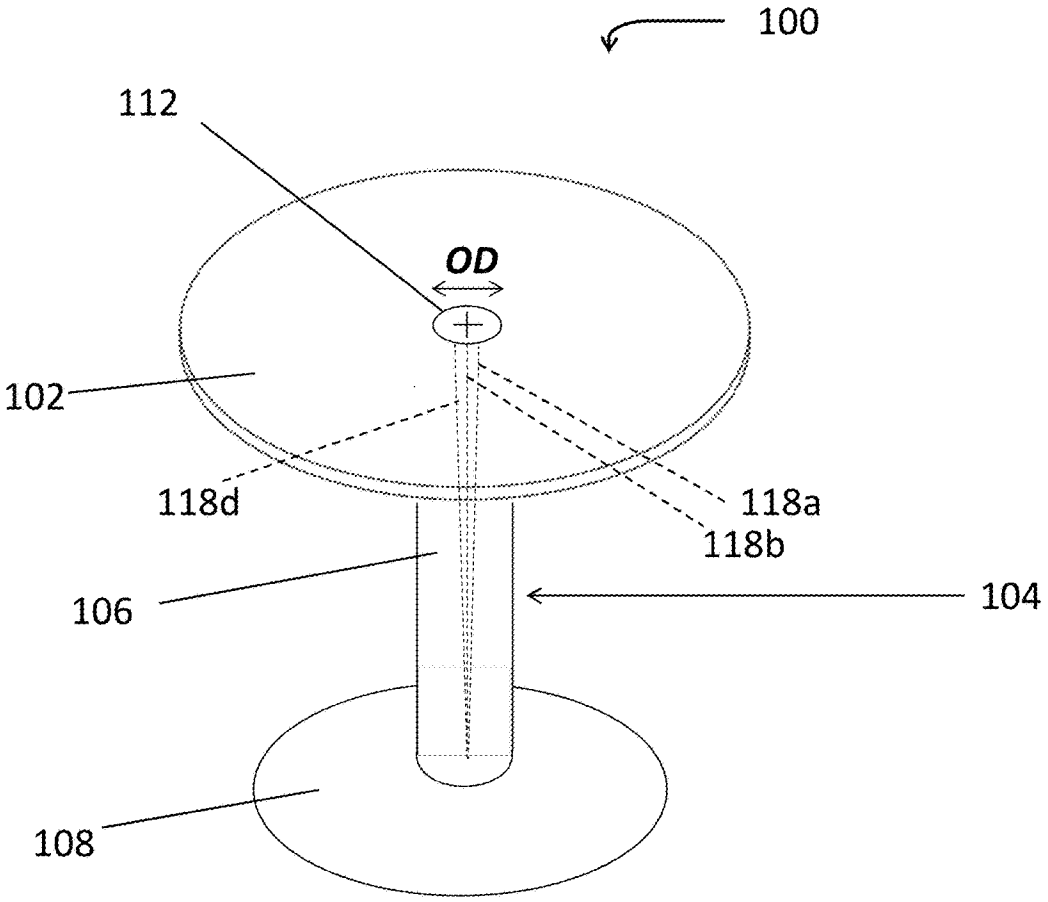
FIG. 2 is a perspective view of a stool according to another embodiment, without any coverings.

As shown in FIGS. 1 and 2, in some embodiments, the base includes a pedestal, with an upper pedestal member 106 that connects the top of the stool to a lower pedestal member 108. As will be appreciated, the lower pedestal member 108 is arranged to rest on a surface, such as a floor. In such embodiments, the lower pedestal member is arranged to rest stably on the surface.

Although the base is shown as being a pedestal in these views, in other embodiments, the base may have other configurations. For example, the base may include a plurality of legs attached to the stool top. In one such example, the base may include four legs that are attached to the bottom surface of the stool top. As will be appreciated, the base may be formed of plastic, wood, metal, or any other appropriate material.

Although the base is shown as being a stationary base in these figures, in other embodiments, the base may have one or more wheels, such as casters, or another suitable means for allowing the base to move between locations.

As will be appreciated, although the stool top and lower pedestal member are shown as being substantially circular in these embodiments, the stool top and lower pedestal member may have other suitable shapes. For example, the stool top and lower pedestal member may have an oval, square, triangular, rectangular, other polygonal, or other shape. As will be further appreciated, although the stool top and lower pedestal member are shown as having the same shape, in other embodiments, the shapes may be different. For example, the stool top may have a circular shape while the lower pedestal member may be square in shape. Additionally, although the stool top and lower pedestal member are shown as being different sizes, with the stool top being larger than the lower pedestal member, in other embodiments, the stool top and lower pedestal member also may be the same size, or the lower pedestal member may be larger than the stool top.

In some embodiments, as shown in FIGS. 1 and 2, the upper pedestal member may be cylindrical in shape (e.g., with a circular cross section). As will be appreciated, the upper pedestal member may have other shapes in other embodiments. For example, the upper pedestal member may have a square cross-sectional shape in some embodiments. The height of the upper pedestal member may vary from embodiment to embodiment, depending up the desired use of the stool. For example, in embodiments in which the stool is used as a table, the upper pedestal member may be longer than in embodiments in which the stool is used as an ottoman.

Figure 3:
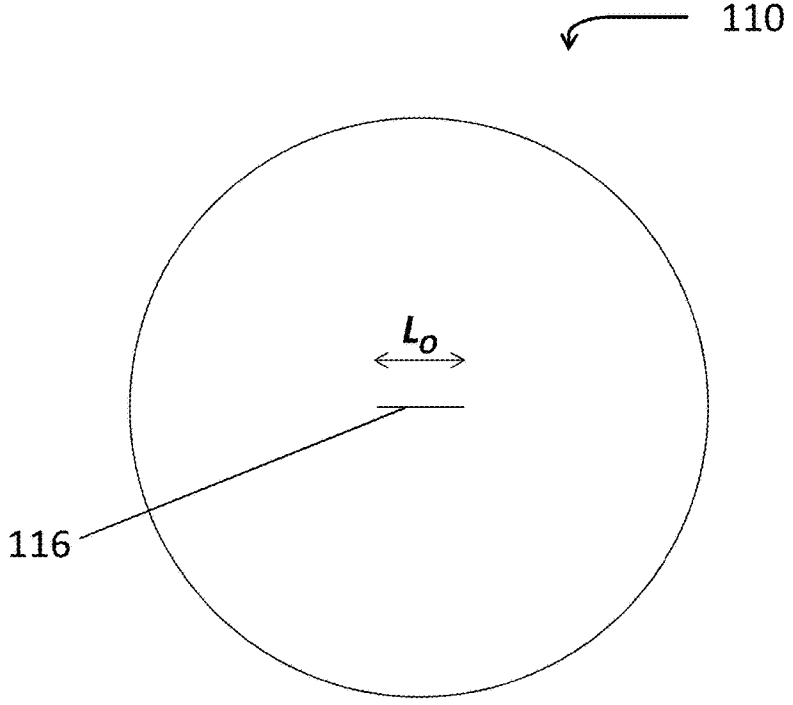
FIG. 3 is a top view of a covering according to one embodiment.

As will be appreciated, the coverings 110 may be formed of fabric or paper and cut to the size and shape of the stool top. In some embodiments, the size and shape of the covering may be the same as that of the top. For example, as shown in FIG. 1, circular-shaped coverings may be held to a circular stool top. In other embodiments, the coverings may be arranged to extend beyond the top of the stool to cover at least a portion of the side of the stool (e.g., like a traditional table cloth), with the coverings being larger than the stool top. As will be appreciated, although the coverings of FIGS. 1 and 3 are shown as being circular, the coverings also may have other suitable shapes.

The coverings may all have the same size, shape, and color, or may differ. For example, a user may attach coverings of different materials depending on the use. In one such example, the user may place a smaller paper covering on the table to be used to take notes during a meeting or may place a larger cloth covering on the table for use while eating. The user also may attach covering having different colors, of the same type of material, for decorative purposes.

In some embodiments, as shown in FIG. 1, the one or more coverings may be arranged in a stack on the stool top. For purposes herein, the stack of coverings may include a plurality of coverings that are placed on top of one another. In such a stack, the coverings may be vertically aligned, such that first and second coverings are centered with respect to one another. The coverings also may be slightly offset from one another.

As shown in FIGS. 1 and 2, in some embodiments, the retaining member 112 may include a flat disk that is attached to the stool. In some embodiments, as shown in these views, the retaining member may be circular in shape. The retaining member may have other suitable shapes in other embodiments. For example, the retaining member may be square, oval, triangular, rectangular, other polygonal or other shape. The retaining member also may have other arrangements in addition to the shown flat disk. For example, the retaining member may be hemispherical in other embodiments.

In some embodiments, the size and shape of the retaining member corresponds to the size and shape of the opening in the covering. If not already big enough, the opening may stretch or change shape as the retaining member is pushed through such that at least one dimension of the opening is greater than or equal to the smallest dimension of the retaining member. As the retaining member is moveable through the opening, at least one outer dimension of the retaining member may be smaller than that of the opening. In such an example, as shown in FIG. 3, the length $L_O$ of the opening is larger than the outer dimension OD of the retaining member 112 (see FIG. 2). As will be appreciated, in embodiments in which the retaining member is circular, such as that shown in FIGS. 1 and 2, the outer dimension OD of the retaining member (e.g., the diameter) is the same throughout.

Although the opening is shown as being in the middle of the covering (with the corresponding retaining member being in the middle of the top of the stool), the opening and corresponding retaining member may be placed in any suitable locations. For example, the opening may be placed near an edge portion of the covering.

As will be appreciated, the disk may be formed of any rigid or semi-rigid material. In some embodiments, the disk may be formed of the same material as the top and/or base of the stool. As will be further appreciated, although the retaining member is shown as being a rigid flat disk with at least one outer diameter smaller than the length of the opening in the covering, the retaining member may have other suitable arrangements. For example, the retaining member may be formed of a material that is bendable, such that the retaining member may be larger than the opening. In such embodiments, the user may bend the retaining member such that the retaining member is sized to fit through the opening in the coverings.

Figure 4:
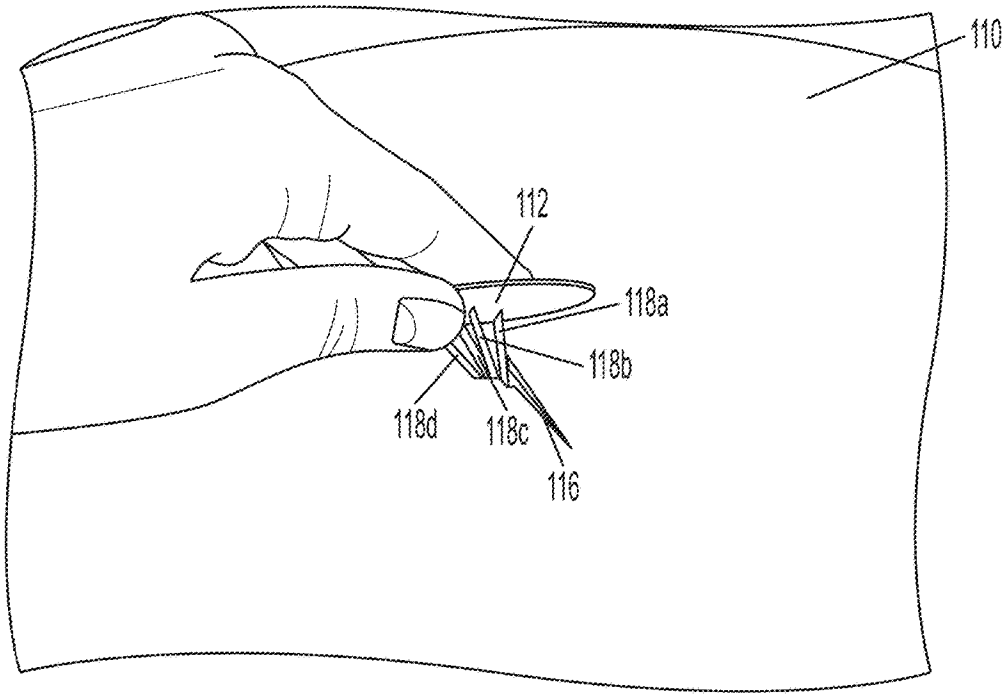
FIG. 4 is an enlarged view of the stool of FIG. 1.

As shown in FIGS. 2 and 4, in some embodiments, the retaining member 112 is connected to the stool via biasing members 118*a*-118*d*. As will be appreciated, although the retaining member is attached to the stool via four biasing members in this embodiment, the retaining member may be attached to the stool via more or fewer biasing members. For example, the retaining member may be attached to the stool via one or two biasing members or via five or more biasing members.

As shown in FIG. 2, in some embodiments, the biasing members may be attached to the base of the stool. For example, the biasing members may be secured at or near the lower pedestal member 108 in some embodiments. In other embodiments, the biasing member may be attached to a portion of the upper pedestal member 106. In still another embodiment, the biasing member may be attached to the top 102 of the stool. As will be appreciated, in an embodiment in which the retaining member is attached via more than one biasing member, each biasing member need not be attached to the same portion of the stool. For example, two of the biasing members may be attached to the lower pedestal member while two of the biasing members may be attached to the top of the stool. In such embodiments, the location of attachment of the biasing members may be used to customize the stretchability of the biasing member and the biasing force applied to the retaining member.

Figure 5B:
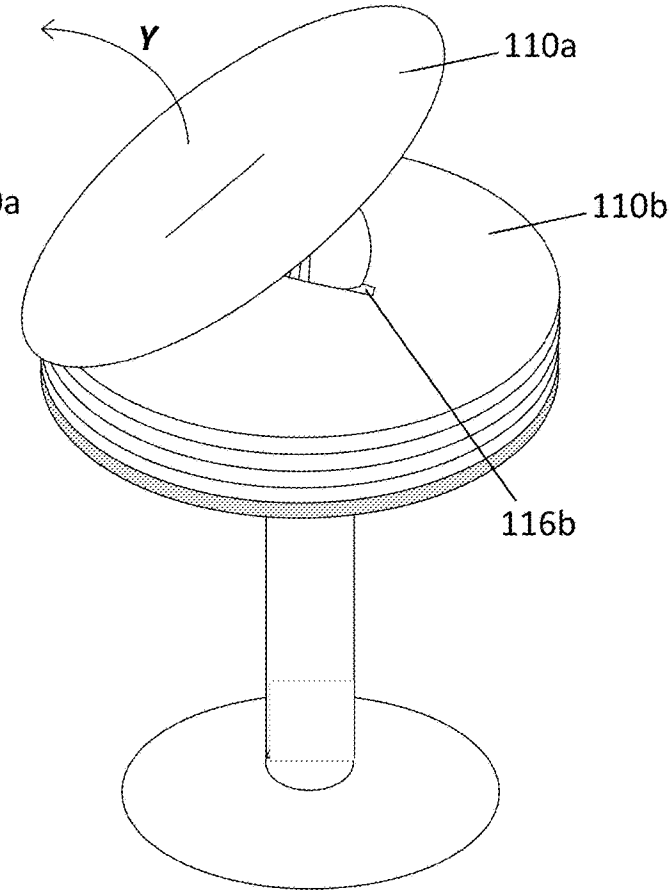
FIGS. 5A-5D illustrate the removal of a covering according to some embodiments.
Figure 5A:
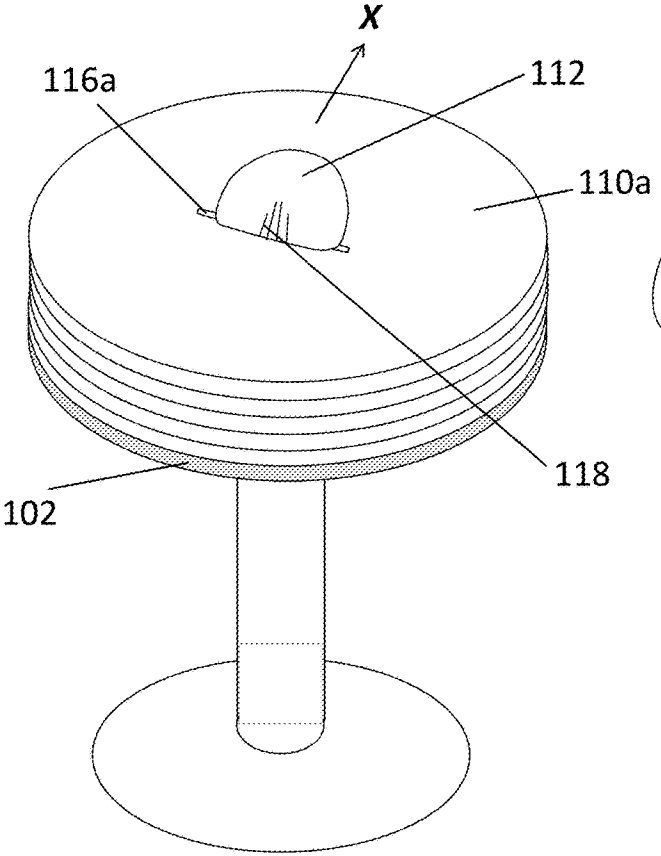

FIGS. 5A-5D show embodiments of a covering being removed from the stool. In such embodiments, the stool includes five coverings stacked on the top 102 of the stool, with the top covering 110*a* being removed from the stack. As will be appreciated, each covering has an opening through which a retaining member 112 can pass (the openings 116*a*, 116*b* of the top two coverings 110*a*, 110*b* are labeled in these views). In these embodiments, the openings are shown as being slits in the coverings. As with other embodiments, the retaining member 112 may be connected via biasing elements 118 to a portion of the stool (e.g., the top or base). As shown in FIG. 5A, the biasing elements also pass through the openings in the coverings.

In some embodiments, as shown in FIG. 5A, to remove a first or topmost covering 110*a*, the retaining element is grasped by a user and moved into an extended position (the user's hand is not shown in these views). In such an extended position, at least a portion of the retaining member 112 is moved away from the top of the stack. For example, a part of a first side of the retaining member is shown as being moved away from the top of the stack in FIG. 5A. In such an extended position, the retaining member 112 may be oriented such that the retaining member is angled relative to the top of the stool and stack of coverings. For example, the retaining member may be angled between about 5 degrees and about 175 degrees. In one such example, the retaining member may be positioned substantially perpendicular to the stack of coverings.

Once the retaining member has been moved into the extended and angled position, the first covering 110*a* may be moved in a direction away from the stack of coverings (see arrow X), such that the retaining member may be removed from the opening 116*a* in the covering.

As shown in FIG. 5B, once the retaining member has been removed from the first covering 102*a*, the first covering 102*a* may be moved in a direction away from the stack of covering (see arrow Y), removing the first covering from the stack. As will be appreciated, although only the top covering is shown as being removed from the stack in this embodiment, one or more coverings may be removed after the first covering is removed. For example, while the retaining member is in the extended and angled position, the second covering 110*b* also may be removed. In another example, multiple coverings may be simultaneously removed at the same time when the retaining member 112 is in the extended and angled position.

Although the retaining member is shown in an angled position to facilitate removal of the covering, it will be appreciated that the retaining member need not be angled. In such embodiments, the covering may be manipulated (e.g., bent and rotated) such that the retaining member may be removed from the opening.

Although not shown in these views, in some embodiments, after the first covering is removed, another covering (not shown) may be placed onto the stack of coverings. For example, a new covering may be moved in a direction opposite to arrow X such that a retaining member may be passed through the opening in the covering and the covering may be placed on the stack.

Figure 5D:
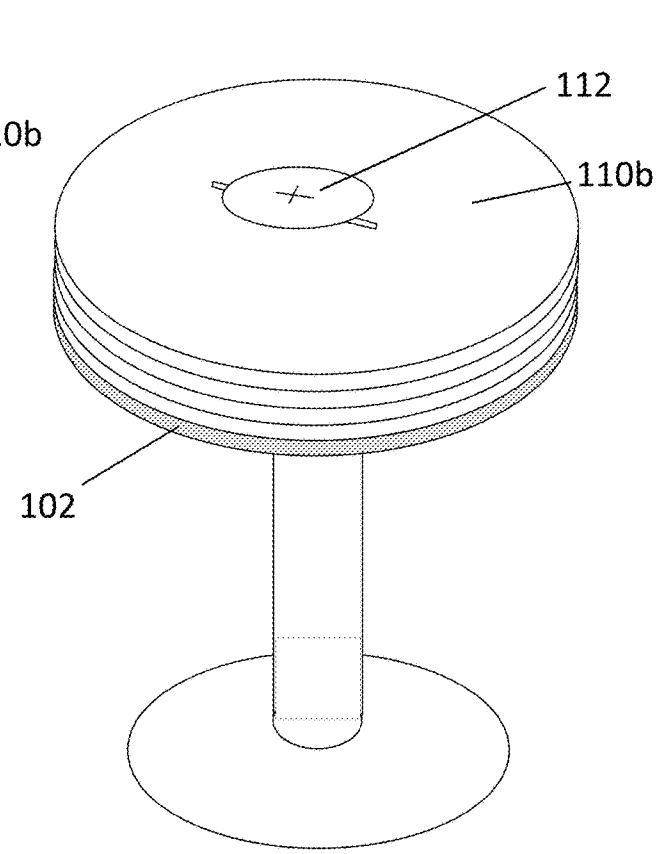
Figure 5C:
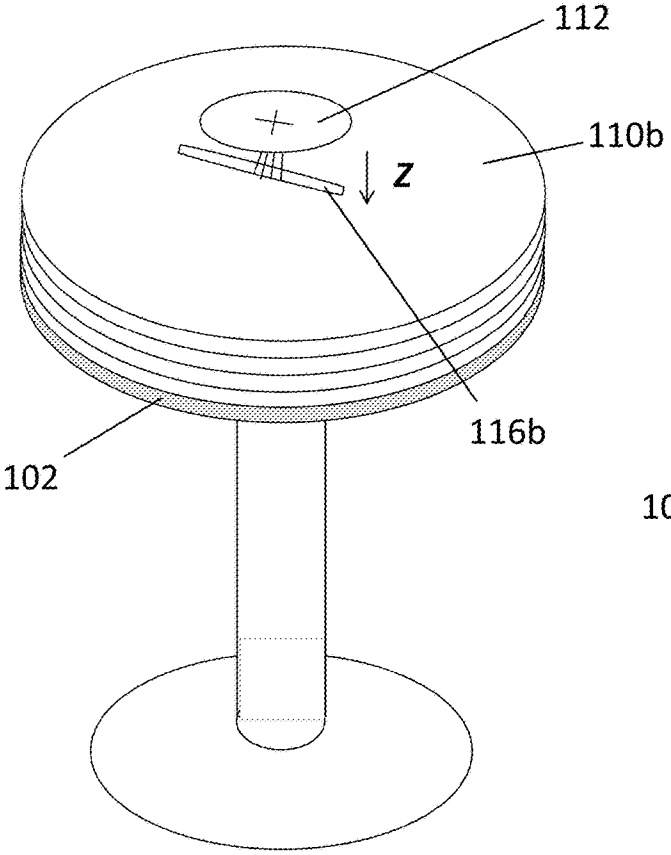

FIG. 5C illustrates the stool after the first covering has been removed. As shown in this view, the stack of coverings includes only four coverings, with the second covering 110*b* positioned at the top of the stack. As also shown in this view, the retaining member 112 is in an extended position but is not angled relative to the top of the stool or to the stack of coverings. Instead, the retaining member is substantially parallel to the stack of coverings and the top of the stool.

Once the covering(s) have been removed, the retaining member 112 may be moved (see arrow Z) back to the to the holding position (see FIG. 5D). In some embodiments, the user manually moves the retaining member 112 into the holding position. In other embodiments, the user may simply release the retaining member. Because the retaining member is biased toward the holding position via the biasing member, upon release of the retaining member, the biasing member pulls the retaining member to a position flush against the second cover 110*b*. As shown in FIG. 5D, the retaining member is substantially parallel to the stack of coverings and the top of the stool in the holding position. In some embodiments, in this holding position, the force of the biasing members on the retaining member holds the stack of covers in place on the top of the stool. In such a position, the retaining member 112 is unable to pass through the openings in the coverings in the stack.

According to another embodiment, a method of holding a covering on a top is disclosed, where the stool includes a top, a base, and a retaining member for holding a plurality of coverings to the top of the stool. In some embodiments, the method includes moving the retaining member in a direction away from the top of the stool to an extended position. The method further includes moving the retaining member through an opening in a first covering. In some embodiments, moving the retaining member to the extended position includes angling the retaining member relative to the top of the stool. The covering then may be moved in a direction away from the top of the stool, and the retaining member may be moved in a direction toward the top of the coverings to a holding position.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A stool, comprising:
a top having a top surface;
a base supporting the top;
a plurality of coverings including first, second, and third coverings stacked on the top surface, wherein the first covering is the topmost covering and is removable from the stool top without removing the second or third coverings from the stool top; and
a retaining member attached to at least one of the top and the base, and biased in a direction toward the top of the stool, wherein the retaining member is positionable on top of the first covering to hold the first, second, and third coverings to the top of the stool.

2. The stool of claim 1, wherein the retaining member is attached to the at least one of the top and the base via one or more biasing members.

3. The stool of claim 2, wherein the one or more biasing members are stretchable.

4. The stool of claim 3, wherein the one or more biasing members comprise elastic bands.

5. The stool of claim 2, wherein the one or more biasing members bias the retaining member toward the top of the stool.

6. The stool of claim 2, wherein the retaining member has a holding position and an extended position, wherein, in the extended position, the retaining member is positioned at a distance from the first covering.

7. The stool of claim 6, wherein, in the extended position, the retaining member is moveable through an opening in the first covering.

8. The stool of claim 6, wherein, in the extended position, the retaining member is positioned at an angle relative to the top of the stool.

9. The stool of claim 6, wherein, in the holding position, the retaining member contacts the first covering.

10. The stool of claim 9, wherein, in the holding position, the first, second, and third coverings are held to the top of the stool.

11. The stool of claim 1, wherein the first, second, and third coverings are held to the top surface.

12. The stool of claim 1, wherein the base includes a pedestal.

13. A stool, comprising:
a top having a top surface;
a base supporting the top;
a plurality of coverings stacked on the top surface; and
a retaining member attached to at least one of the top and the base, and biased in a direction toward the top of the stool, wherein the retaining member is arranged to hold the coverings to the top of the stool, wherein each of the plurality of coverings includes an opening for receiving the retaining member.

14. The stool of claim 13, wherein the opening includes a slit.

15. The stool of claim 1, wherein the coverings are paper coverings.

16. The stool of claim 1, wherein the coverings are cloth coverings.

17. The stool of claim 1, wherein the plurality of coverings are attached to one another.

18. A stool, comprising:
a top having a top surface;
a base supporting the top;
a plurality of coverings stacked on the top surface; and
a retaining member attached to at least one of the top and the base, and biased in a direction toward the top of the stool, wherein the retaining member is arranged to hold the coverings to the top of the stool, wherein the retaining member includes a flat disk.

19. A stool, comprising:
a top having a top surface;
a base supporting the top;
a plurality of coverings stacked on the top surface; and
a retaining member attached to at least one of the top and the base, and biased in a direction toward the top of the stool, wherein the retaining member is arranged to hold the coverings to the top of the stool,
wherein the retaining member is attached to the at least one of the top and the base via one or more biasing members, and the retaining member has a holding position and an extended position, wherein in the extended position, the retaining member is positioned at a distance from a top covering of the plurality of coverings, and in the holding position, the retaining member contacts the top covering of the plurality of coverings and the one or more biasing members extend through openings in the coverings.

20. A method of holding a covering on a stool, the stool having a top, a base supporting the top, and a retaining member attached to at least one of the top and the base and biased in a direction toward the top of the stool, the retaining member arranged to hold one or more coverings to the top of the stool, the method comprising:

moving the retaining member in a direction away from the top of the stool to an extended position;

inserting the retaining member through an opening of a first covering;

placing the first covering on the top of the stool.

21. The stool of claim 1, wherein the plurality of coverings includes fourth and fifth coverings, the fourth and fifth coverings being stacked on the top surface under the first, second, and third coverings.

22. The stool of claim 1, wherein the first, second, and third coverings are planar coverings.

* * * * *